United States Patent [19]

Wassen et al.

[11] 4,006,622

[45] Feb. 8, 1977

[54] CONTINUOUS PROCESS FOR THE PRODUCTION OF VERY LONG PRECISION TUBES AND INSTALLATION FOR CARRYING OUT THE PROCESS

[75] Inventors: Johann Wassen, Brackwede; Heinz Kron; Hans Pferdekamper, both of Dusseldorf, all of Germany

[73] Assignee: Mannesmannrohren-Werke AG, Dusseldorf, Germany

[22] Filed: July 25, 1975

[21] Appl. No.: 599,186

[30] Foreign Application Priority Data

Aug. 1, 1975 Germany ..... 2437441

[52] U.S. Cl. ..... 72/206; 72/283

[51] Int. Cl.[2] ..... B21B 15/00

[58] Field of Search ..... 72/206, 283, 370

[56] References Cited

UNITED STATES PATENTS 3,581,384 6/1971 Petersen et al. ..... 29/527.7

3,661,005 5/1972 Petersen et al. ..... 72/206

FOREIGN PATENTS OR APPLICATIONS 1,021,669 2/1953 France ..... 72/206

*Primary Examiner*—Lowell A. Larson

*Attorney, Agent, or Firm*—Cullen, Settle, Sloman & Cantor

[57] ABSTRACT

A novel method and a novel apparatus for continuously forming a very long tube with precise internal and external dimensions from a metal tube blank by reducing the internal diameter of the blank to that of an internal mandrel on which the blank is telescoped, preferable by cold forming the blank onto the mandrel and immediately thereafter, drawing of the tube while it is still on the mandrel to its final external dimension; with no annealing taking place between the two steps.

5 Claims, 1 Drawing Figure

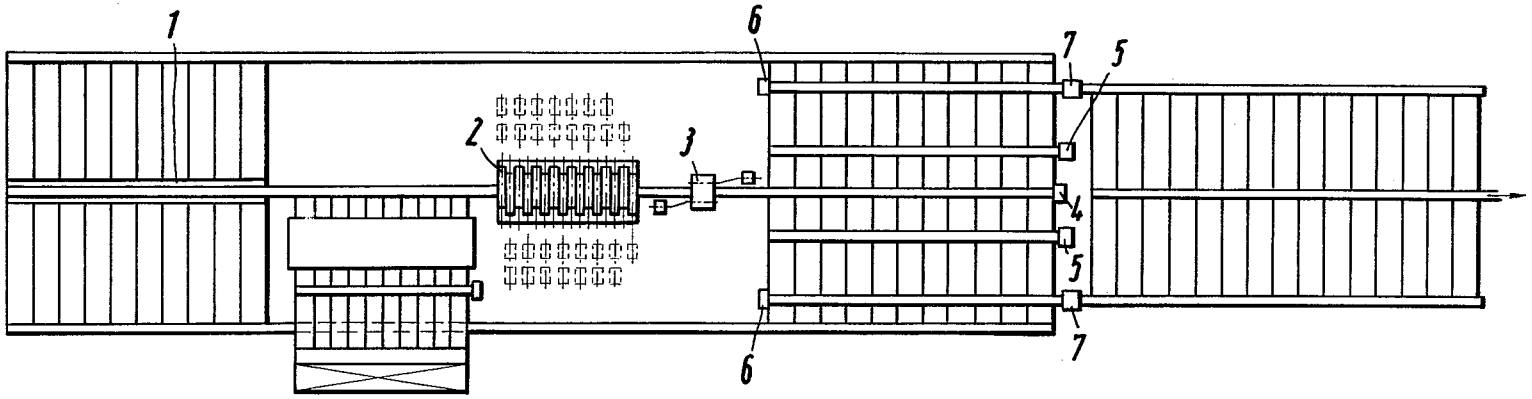
1
2
3
4
5
5
6
6
7
7

CONTINUOUS PROCESS FOR THE PRODUCTION OF VERY LONG PRECISION TUBES AND INSTALLATION FOR CARRYING OUT THE PROCESS

The invention relates to a continuous process for the production of very long precision tubes with an improved surface and dimensional accuracy from tube blanks of metals or metal alloys and an installation for carrying out the process.

BACKGROUND OF THE INVENTION

With the hitherto known processes, a reduction in cross-section of more than 60 percent is not possible in continuous process in the usual diameter range.

SUMMARY OF THE INVENTION

The invention has for its aim to provide a continuous process which makes it possible to produce very long precision tubes without intermediate annealing.

To achieve this object according to the invention a process is proposed whose individual process steps consist of fitting a suitably chamfered or narrowed tube blank on to a mandrel bar having a length of at least 30 m, which is preceded by a drawing plug, cold reducing the blank in a reducing mill, releasing the stock from the mandrel bar, drawing-in that end of the stock which advanced beyond the mandrel bar front edge, without intermediate annealing, introducing the tube into a endless drawing apparatus and holding the mandrel bar at its rear end, and also extracting or expelling it, deforming the tube by drawing to the final dimensions.

In a modification of the process the overhung-mounted plug is first inserted in the advanced tube end.

Following these measures, the completed tube is subjected to finishing operations.

In accordance with the particular chemical composition of the tube blanks, they can be preheated to a temperature above room temperature and below the scale limit.

DETAILED DESCRIPTION OF THE INVENTION

The installation according to the invention for the production of very long precision tubes from tube blanks, comprises a device by means of which a tube blank is fitted onto a mandrel bar, a cold reducing mill, a device for releasing the blank, a plug inserting device, a blank end drawing-in device, a mandrel bar holding device and an endless drawing device.

If desired, a preheating device can be arranged upstream of the device for fitting the blank on the mandrel bar. The preheating temperature is so low that even if the blank is preheated it is then reduced in a cold reducing unit.

The production of very long precision tubes according to the present invention involves several steps.

The tube blank, which may be descaled and preferably comes from a hot production processor or a welding apparatus is first fitted on to a mandrel bar which is about 30 m in length. This is preferably effected by pushing the mandrel bar into the tube blank, e.g. by driving rollers. While this is being done the mandrel bar may already be provided with a plug or mandrel.

The blank is then reduced in a cold reducing mill. In cold reducing the tube blank is extended over the mandrel bar with the aid of several rolling stand, e.g. two or more rolling stands, of known design arranged one behind the other. While this is happening the front end of the resulting tube advances beyond the head of the mandrel bar.

During or after the rolling process the tube, which in accordance with the particular calibration only partly rests at its internal periphery on the mandrel bar, is released by suitable means, e.g. by the pressure of the release rollers of a detaching mill.

After issuing from the rolling mill, the tube end which had advanced over the mandrel bar is drawn in. It is also possible to insert a plug first in the advanced tube end. The mandrel bar is then either held securely and put out, or pushes against the plug at subsequent drawing of the tube and is thus forced out. If the mandrel bar was not provided with a plug or mandrel at the beginning of the process a plug or mandrel is now inserted in the tube end which has advanced beyond the mandrel bar. Without the usual intermediate annealing the tube is immediately drawn to its final dimensions in an endless drawing followed in succession by the usual finishing operations such as dividing, annealing, end processing, non-destructive testing, tolerance control and surface inspection.

During the drawing-in the tube is drawn-in for the subsequent drawing of the tube, i.e. holding means is provided. The removal of the mandrel bar from the tube occurs during the drawing process either by securing the mandrel bar, or the bar is pressed out of the tube, on striking the plug or mandrel, by the latter. The drawing of the tube to its final dimension takes place on an endless drawbench, e.g. a multiple slide bench or a caterpiller drawing installation.

The advantages of the combined process according to the invention consist more particularly in that the use of thick walled tube blanks is considerably more economical. The term "thick walled tube blank" is intended to mean a tube blank in which the ratio of the wall thickness to the outer diameter is 0.15 or more. It is possible to operate with the maximim blank charge in the mill. Owing to the reduction in the number of blank sizes required, it is also possible to keep smaller stocks. Very high amounts of deformation can be obtained in an operation, which may amount to more than 80 percent. Also, as a result the external and internal surfaces are consolidated to a considerable extent, and this also results in improving the quality of the surfaces and the tolerances. Finally, a precision tube of very great length is obtained whilst dispensing with the usual intermediate annealing after endless drawing.

THE DRAWING

The combined installation according to the invention is shown in diagrammatic manner in the accompanying drawing.

This drawing shows a device 1 by means of which a tube blank is fitted on to a mandrel bar, the device being positioned in front of the cold reducing mill 2. Downstream thereof there are arranged a mandrel bar releasing device 3, and a plug inserting device 4, downstream of which two finishing devices are arranged. Each of the finishing devices comprises a tube end drawing-in device 5, a mandrel bar holding device 6, and an endless drawing device 7. The endless drawing devices 7 are followed by the usual finishing apparatus. The arrangement of two finishing devices 5, 6. 7 increases productivity of the installation.

What we claim is:

1. A process for continuously producing long metal tubing to precise diameters from tubular metal blanks comprising:

a. telescoping a tubular blank onto a long mandrel;

b. cold forming the blank onto the mandrel, reducing the internal diameter of the blank to the diameter of the mandrel, and simultaneously elongating the blank forwardly to advance ahead of the mandrel and ahead of the cold forming means;

c. releasing the reduced blank from tight engagement with the mandrel, but leaving the telescoped blank on the mandrel for its support;

d. immediately thereafter and continuously pulling the blank through a drawing apparatus as it leaves the cold forming step for drawing in of the blank, all of the while the mandrel is in the blank and is still being held at its rear end; whereby the blank is drawn to final dimension continuously and immediately after it leaves the cold forming step, to be drawn in without any intermediate annealing, the removal of the mandrel from the tube occurring during the drawing process.

2. A process according to claim 1, wherein an overhung-mounted plug is inserted in the advanced tube end.

3. A process according to claim 1, wherein before being fitted into the mandrel bar the tube blank is preheated to a temperature which is between room temperature and the scale limit.

4. An installation for the continuous production of very long precision tubes from tube blanks of metals or metal alloys comprising a device for fitting a tube blank onto a mandrel bar;

a cold rolling mill for forming the blank onto the mandrel reducing its internal diameter to the diameter of the mandrel;

a tube releasing device downstream of said cold reducing mill for disengaging the tube from said mandrel;

a plug inserting device for inserting a plug into the tube leading end;

at least one finishing device including a tube end drawing-in device;

a mandrel bar holding device;

and an endless drawing device downstream of the plug inserting device.

5. An installation according to claim 4, wherein a preheating device is arranged upstream of the mandrel bar fitting-on device.

* * * * *